US011040365B2

(12) United States Patent
Lee

(10) Patent No.: US 11,040,365 B2
(45) Date of Patent: Jun. 22, 2021

(54) HIGH OUTPUT MINI FOAMER

(71) Applicant: RIEKE PACKAGING SYSTEMS LIMITED, Leicester (GB)

(72) Inventor: Yen Kean Lee, Rohnert Park, CA (US)

( * ) Notice: Subject to any disclaimer, the term of this patent is extended or adjusted under 35 U.S.C. 154(b) by 342 days.

(21) Appl. No.: 15/999,293

(22) PCT Filed: Feb. 14, 2017

(86) PCT No.: PCT/IB2017/000208
§ 371 (c)(1),
(2) Date: Aug. 17, 2018

(87) PCT Pub. No.: WO2017/141110
PCT Pub. Date: Aug. 24, 2017

(65) Prior Publication Data

US 2020/0331015 A1 Oct. 22, 2020

Related U.S. Application Data

(60) Provisional application No. 62/296,337, filed on Feb. 17, 2016, provisional application No. 62/327,008, filed on Apr. 25, 2016.

(51) Int. Cl.

| | |
|---|---|
| ***B05B 11/00*** | (2006.01) |
| ***A47K 5/14*** | (2006.01) |
| *A47K 5/12* | (2006.01) |

(52) U.S. Cl.
CPC ..... *B05B 11/3087* (2013.01); *A47K 5/14* (2013.01); *A47K 5/1205* (2013.01); *A47K 5/1211* (2013.01); *B05B 11/3047* (2013.01)

(58) Field of Classification Search
CPC ..... A47K 5/14; A47K 5/1211; A47K 5/1205; B05B 11/3087; B05B 11/3047
See application file for complete search history.

(56) References Cited

U.S. PATENT DOCUMENTS

| | | | | |
|---|---|---|---|---|
| 2015/0366416 | A1 | 12/2015 | Hoefte et al. | |
| 2018/0153353 | A1* | 6/2018 | Takagi | B05B 12/122 |
| 2018/0154379 | A1* | 6/2018 | Knight | B05B 7/0037 |
| 2018/0326434 | A1* | 11/2018 | Aoyama | B05B 11/306 |
| 2018/0360276 | A1* | 12/2018 | Yang | B05B 11/3087 |

FOREIGN PATENT DOCUMENTS

| | | | |
|---|---|---|---|
| JP | 2012120966 A | * | 6/2012 |
| JP | 2012120966 A | | 6/2012 |

OTHER PUBLICATIONS

International Search Report and Written Opinion dated May 16, 2017; International Patent Application No. PCT/IB2017/000208 filed Feb. 14, 2017; ISA/EP.

* cited by examiner

*Primary Examiner* — Donnell A Long
(74) *Attorney, Agent, or Firm* — McDonald Hopkins LLC

(57) ABSTRACT

A foamer for use in dispensing a dosage of a product which has a foam consistency is disclosed. The foamer is described as having a high output and as being a mini foamer such that the associated pump engine is able to deliver a dosage for each stroke which is in excess of that dosage normally associated with mini foamers. The receptacle to which the pump engine is assembled has a neck finish which is smaller than those neck finishes normally associated with higher output foamers. The resulting combination as set forth herein is to provide a higher output dosage without changing the size benefits and preferences of a mini foamer.

5 Claims, 15 Drawing Sheets

HIGH OUTPUT MINI FOAMER

CROSS-REFERENCE TO RELATED APPLICATION

This application is a 35 U.S.C. 371 national stage filing of PCT Application No. PCT/IB2017/000208 filed on Feb. 14, 2017, entitled "HIGH OUTPUT MINI FOAMER," which claims priority to U.S. Provisional Patent Application No. 62/296,337, filed on Feb. 17, 2016, and U.S. Provisional Patent Application No. 62/327,008 Apr. 25, 2016, each of which are incorporated herein in their entirety by reference.

BACKGROUND

Dispensers for flowable products can be grouped or categorized by the type or nature of the product being dispensed, such as a liquid, cream, lotion, foam, etc. Additionally, each of these product categories may be further defined or identified based on product density or viscosity. Product which is to be dispensed (i.e. delivered by the dispenser upon plunger actuation) as a foam or with a foam consistency is an aerated mixture of a liquid and a gas, typically air. The dispenser for this type of product is often referred to in the trade as a "foamer" and this term is used herein to describe the dispenser of the exemplary embodiments of the present invention.

One design consideration which is related to foamers is the ease of use which includes ergonomic considerations such as size and shape, as but two examples of ergonomic considerations. Ease of use also includes the specifics of the pump mechanism or engine which is used to draw in liquid and air into a mixing chamber or mixing region prior to dispensing the mixture of liquid and air as a foam or with a foam consistency. In terms of the size and shape of the foamer, one design aspect is the intended stroke length of the actuator or pump engine plunger. Another design aspect is physical size, such as the overall height and body size, often expressed as a diameter. Another size factor which may be specified, perhaps in lieu of a body diameter, is the size of the neck finish on the receptacle, typically an externally-threaded neck of a container or bottle. The size of the bottle neck finish is usually expressed as a millimeter size, such as 40 mm or 33 mm, as but two examples.

Current product packages for foamers often tie together the overall bottle size, i.e. diameter and height, in a proportional manner to the size of the neck finish. While not a mandated relationship, there are a variety of health and beauty care products, as well as personal care and household products, where there is a relationship. Further, in the case of foamers when the neck finish and other bottle dimensions are specified, there are usually corresponding dimensional limitations, even if self-imposed on the pump mechanism by the designer. This in turn may limit the size of the air chamber, the size of the liquid chamber and the stroke length. These aspects of the foamer construction and design typically limit the dosage of foam product which is delivered as a result of each down stroke of the actuator/plunger.

Conventional wisdom suggests to a designer that if a larger dosage is desired, all with a single stroke of the pump engine actuator, then simply increase the chamber sizes, likely both air and liquid, and increase the stroke length. The concern though is that these increases result in larger pumps and larger bottles which means the use of significantly larger amounts of plastic. A related increase is an increase in production cycle times meaning higher production costs. There is also a consumer consideration in that the current packaging may be preferred and changing to a larger package may not be acceptable to some consumers of the current product. In view of these design realities and the realization of a customer market for a higher dosage foamer without a corresponding increase in the size of the neck finish of the bottle, the present invention was conceived of as disclosed herein by the exemplary embodiments.

SUMMARY

The disclosed foamer provides an output dosage which is comparatively higher than that possible with current "mini foamer" designs, while still being able to fit bottles with a neck finish which is approximately 33 mm. The pump engine for a foamer normally includes an air chamber and a liquid chamber. These design requirements create limitations in terms of engine size. Currently, foamers which are constructed and arrange for bottles with a 40 mm neck finish are able to deliver a product dosage, in this case with a foam consistency, of 0.8 cc to 1.5 cc, with each down stroke of the actuator.

Foamers with a smaller dosage are available, but their typical dosage is 0.4 cc. The smaller dosage foamers are commonly termed "mini foamers" and are typically suitable for bottles with neck finishes smaller than 40 mm. However, a dosage of approximately 0.4 cc is considered by some companies and consumers as not being desirable for a number of applications including most hand washing, cleaning and shower applications.

The present invention, as represented by the exemplary embodiments, addresses the need for a higher dosage from a "mini foamer". More specifically, the present invention provides a novel and unobvious sizing and arrangement of component parts which result in a higher output mini foamer. The design focus herein is on the component part dimensions and the dimensional ratios of the more important dimensions. The target dosage of the present invention is approximately 1.0 cc to 1.1 cc. The suitable and cooperating bottle has a neck finish of approximately 33 mm. This new foamer is logically referred to as a "high output mini foamer". Since "high" is arguably a relative term, it will be defined herein as meaning a dosage of at least 0.8 cc which happens to be roughly twice the current dosage of known mini foamers. To the extent that "mini" is also deemed to be a relative term, it is defined herein as being suitable to fit onto and function with a bottle or similar container (receptacle) which has a neck size of less than 36 mm. While these terms and numbers are provided here for reference and convenience, the specification provides disclosure of specific dimensions ad specific dimensional ratios which are considered to be critical to the success of the design. Further, the claims are directed to the structural elements and the structural relationships which include recitation of these critical dimensions and dimensional ratios.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
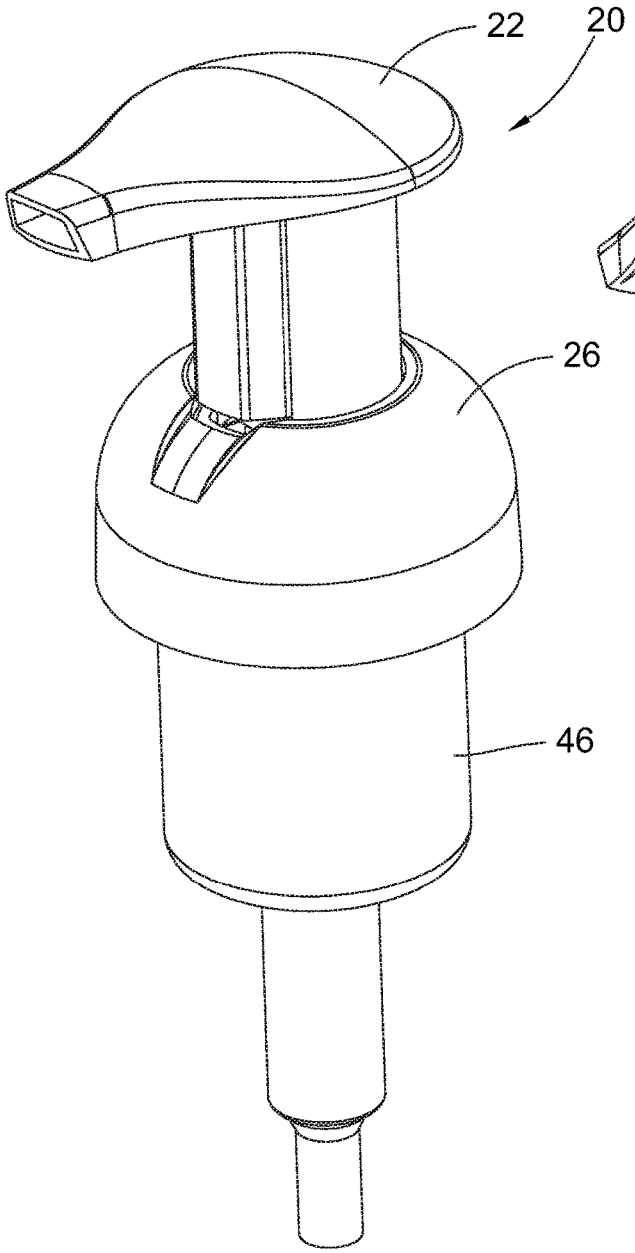
FIG. 1 is a perspective view of a high output mini foamer according to an exemplary embodiment of the present invention.
Figure 2:
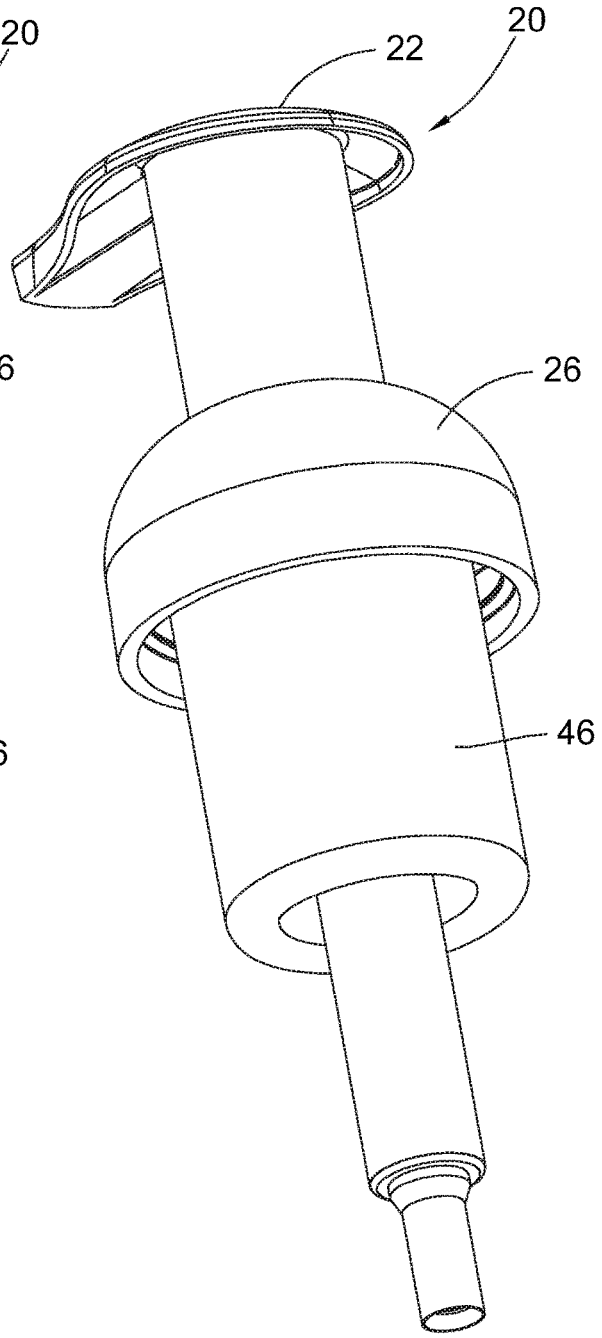
FIG. 2 is a perspective view of the FIG. 1 foamer.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

The high output mini foamer 20 according to the present invention is illustrated in FIGS. 1 through 12. The details of what is illustrated and the relevance of this construction to the design challenge are explained below. The disclosed high output mini foamer 20 is suitable for products such as liquid hand soap, hand sanitizer, face wash, liquid food substances, car care, leather care, plant food and cleaning agents, as a few examples.

Brief overview of some of the design reasons and design challenges for the present invention.

- cost reduction: current high output foamer pump consumes significantly larger amount of plastic thus longer cycle time and higher production costs
- Sales opportunity for hand wash, cleaner, body wash, etc. for a higher output foaming product. Higher output foamer pumps (0.8 cc to 1.5 cc) requires a minimum neck size of 40 mm. Customers with existing bottles that are less than 40 mm neck finish may not be willing to make the change in bottle which would require investment on new bottle tooling

State of the Art

A typical foamer pump engine consists of an air chamber and a liquid chamber and these components create a limitation in terms of engine size. A typical foamer pump which is intended to deliver a 0.8 cc to 1.5 cc dosage currently requires a 40 mm closure as well as 40 mm bottle neck finish due to the design nature of such large foamer pump engine.

Mini foamers are available in the market place today but are only available in 0.4 cc dosage, which is not desirable for most hand wash, cleaning or shower application.

With the new high output mini foamer design according to the exemplary embodiment of the present invention:

- cost reduction is achieved through plastic resin weight reduction
- Increase of sales opportunity; availability of foamer pump for customers who desire to utilize their existing bottles which are mostly smaller than 40 mm neck size
- Addition of high output mini foamers for portable application

Overview

The disclosed high output mini foamer 20 is designed to deliver an approximate 1.0 cc to 1.1 cc dosage while having the engine compatible with a smaller than conventional foamer bottle. The high output mini foamer would fit with bottles as small as 33 mm neck finish compare to conventional foamer pump that would require 40 mm neck finish to deliver such high output. Through redesign of the size of the pump engine size (both air chamber and liquid chamber), the pump travel distance, and the air to liquid ratio, the exemplary embodiment as shown in FIGS. 1-12 is able to obtain approximately a 1.0 cc to 1.1 cc output from this new 33 mm mini foamer pump.

With continued reference to FIGS. 1-12, the illustrated high output mini foamer 20 is shown as attached to a bottle 21 or similar product receptacle. The sizes and shapes of what would constitute a suitable and compatible bottle 21 for foamer 20 may vary over a wide range depending on the product and depending on the designer preferences. For the purposes of this disclosure and as representative of the exemplary embodiment, the selected product bottle has an externally-threaded neck finish size which is less than 36 mm. This size limitation distinguishes the present invention from current "high" output foamers which typically have a 40 mm (or larger) neck finish. In the exemplary embodiment of the present invention, the internally-threaded collar 26 which connects to the bottle neck finish is sized and arranged for connection to a 33 mm bottle neck finish. This 33 mm bottle neck finish size places the exemplary embodiment in the category of "mini" foamers, as explained herein.

Figure 10:
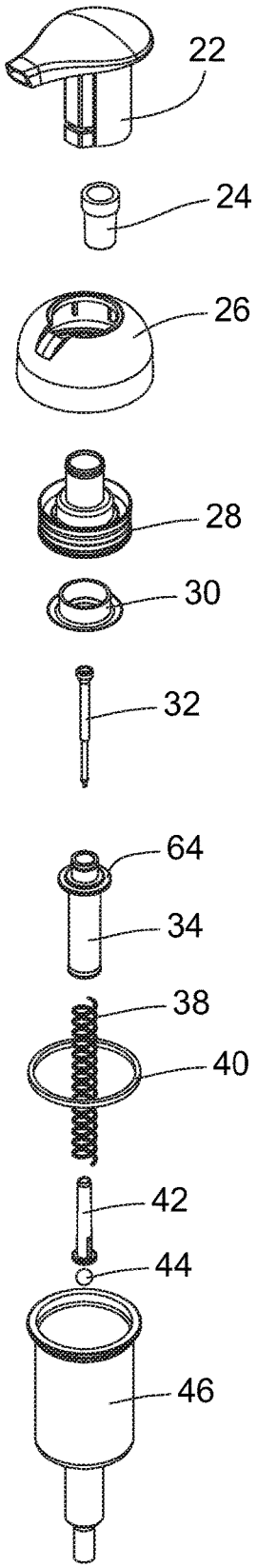
FIG. 10 is an exploded view of the component parts of the FIG. 1 foamer as a perspective view.
Figure 11:
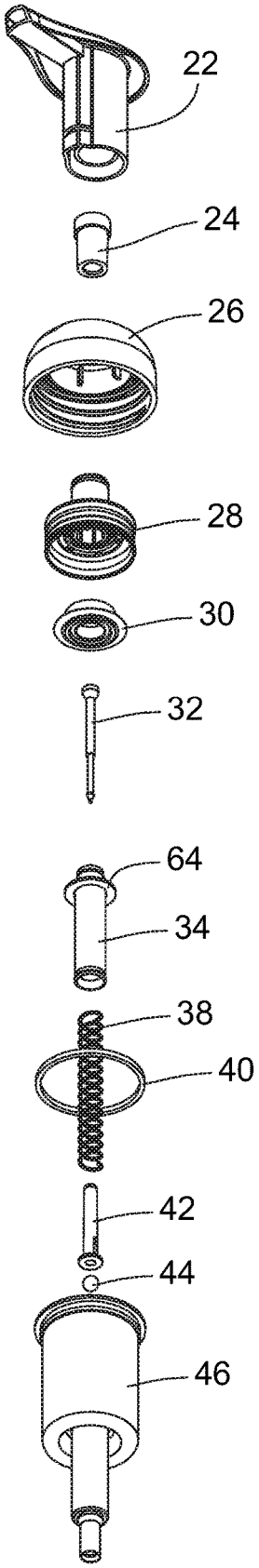
FIG. 11 is an exploded view of the component parts of the FIG. 1 foamer as a perspective view.
Figure 12:
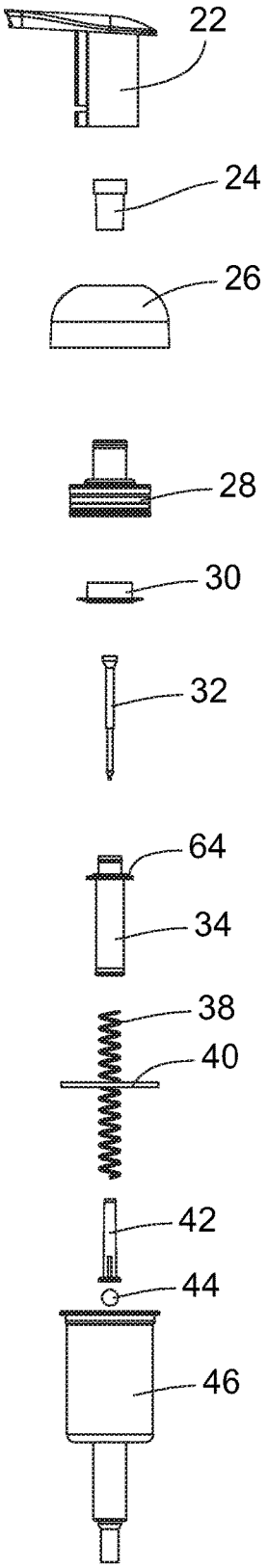
FIG. 12 is an exploded view of the component parts of the FIG. 1 foamer as a right side elevational view.
Figure 13:
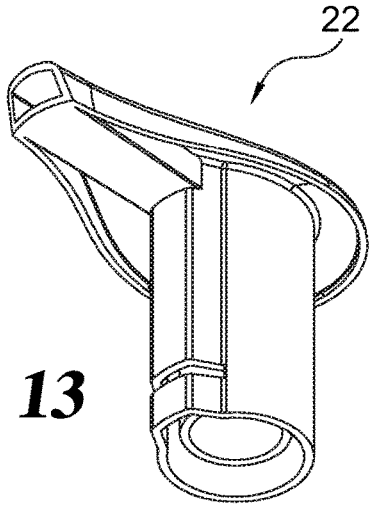
FIG. 13 is a perspective view of an actuator which comprises one component part of the FIG. 1 foamer.
Figure 14:
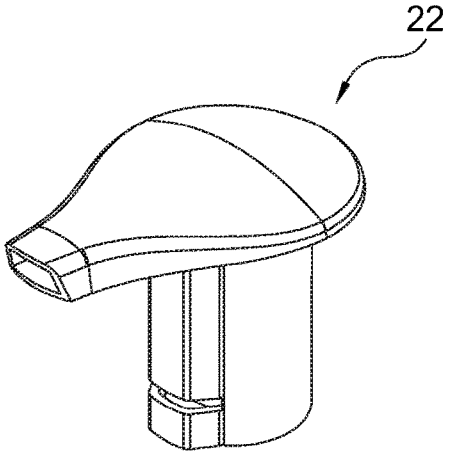
FIG. 14 is a perspective view of the FIG. 13 actuator.
Figure 15:
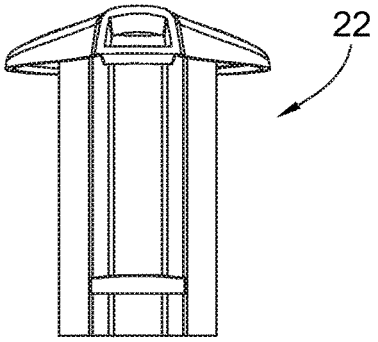
FIG. 15 is a front elevational view of the FIG. 13 actuator.
Figure 16:
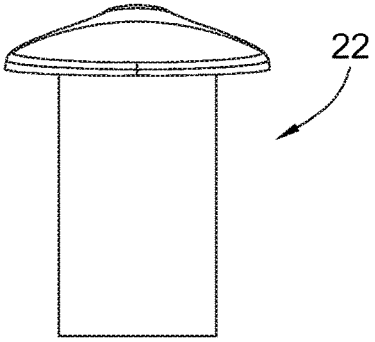
FIG. 16 is a rear elevational view of the FIG. 13 actuator.
Figure 17:
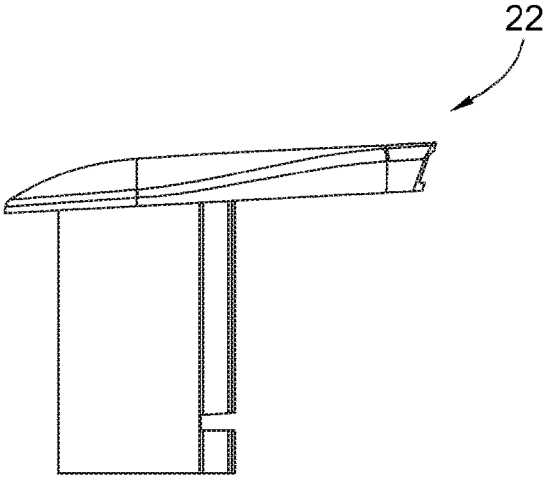
FIG. 17 is a left side elevational view of the FIG. 13 actuator.
Figure 18:
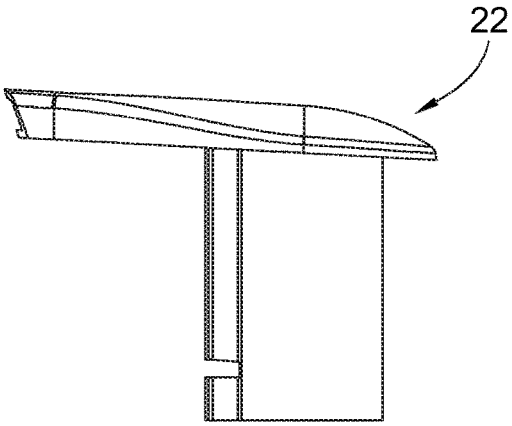
FIG. 18 is a right side elevational view of the FIG. 13 actuator.
Figure 19:
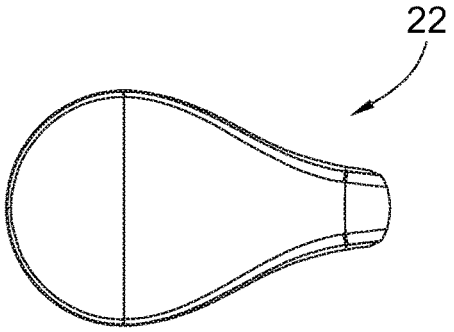
FIG. 19 is a top plan view of the FIG. 13 actuator.
Figure 20:
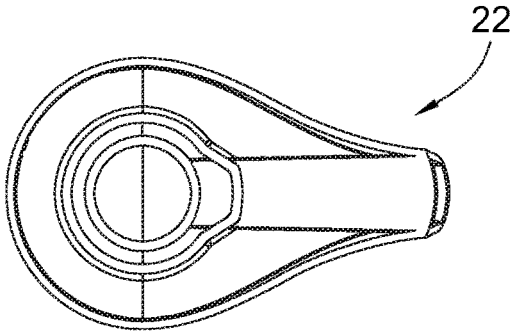
FIG. 20 is a bottom plan view of the FIG. 13 actuator.
Figure 21:
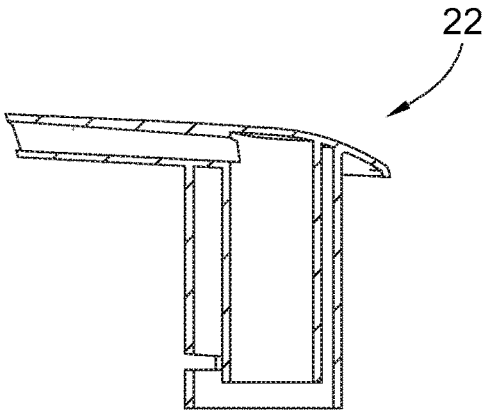
FIG. 21 is a right side elevational view, in full section, of the FIG. 13 actuator.
Figure 22:
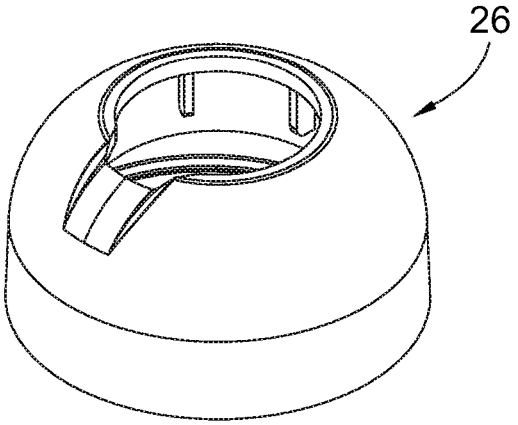
FIG. 22 is a perspective view of a collar which comprises one component part of the FIG. 1 foamer.
Figure 23:
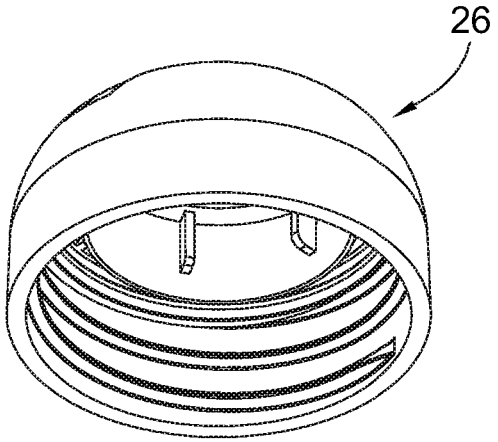
FIG. 23 is a perspective view of the FIG. 22 collar.
Figure 24:
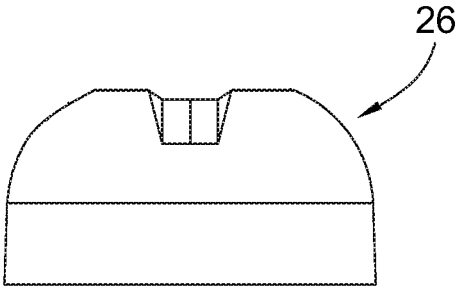
FIG. 24 is a front elevational view of the FIG. 22 collar.
Figure 25:
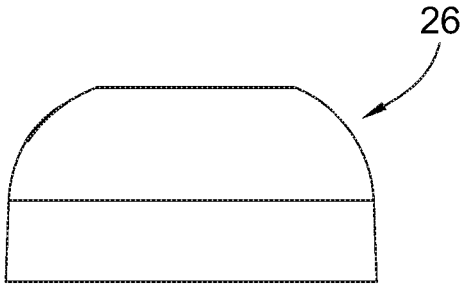
FIG. 25 is a right side elevational view of the FIG. 22 collar.
Figure 26:
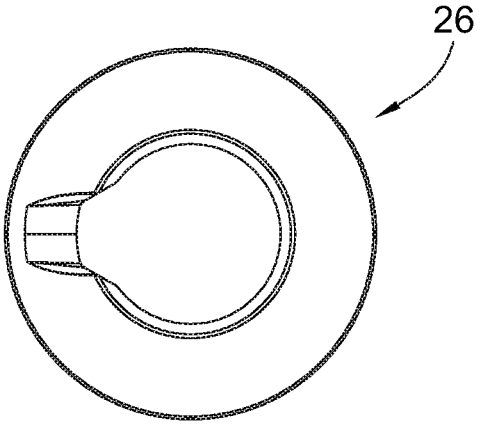
FIG. 26 is a top plan view of the FIG. 22 collar.
Figure 27:
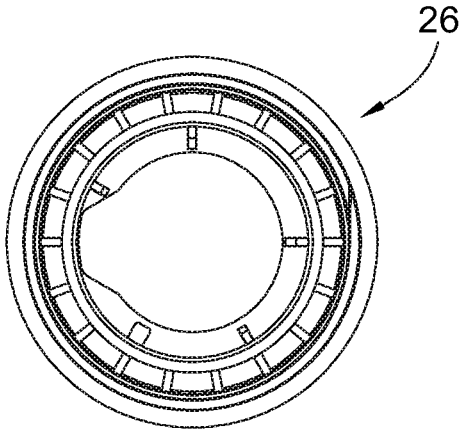
FIG. 27 is a bottom plan view of the FIG. 22 collar.
Figure 28:
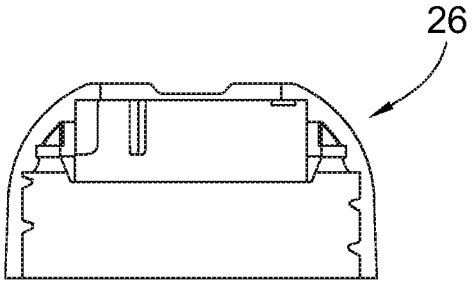
FIG. 28 is a front elevational view, in full section, of the FIG. 22 collar.
Figure 29:
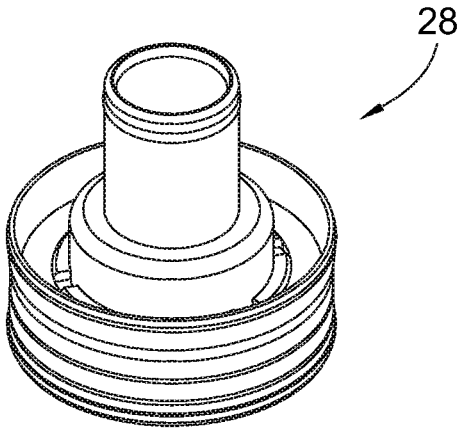
FIG. 29 is a perspective view of a piston which comprises one component part of the FIG. 1 foamer.
Figure 30:
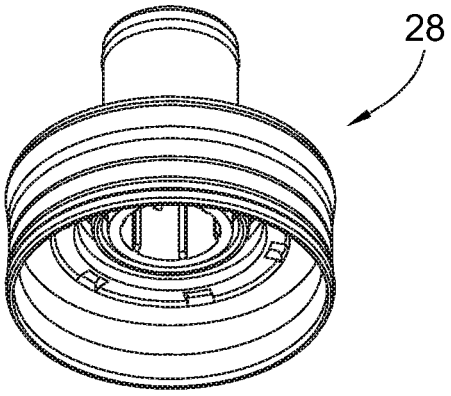
FIG. 30 is a perspective view of the FIG. 29 piston.
Figure 31:
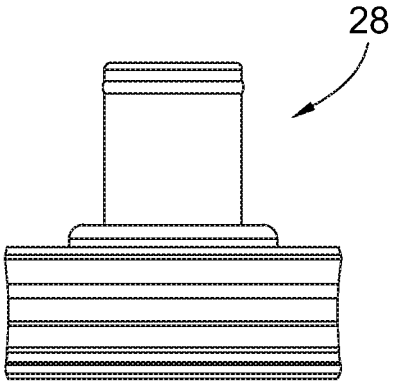
FIG. 31 is a front elevational view of the FIG. 29 piston.
Figure 32:
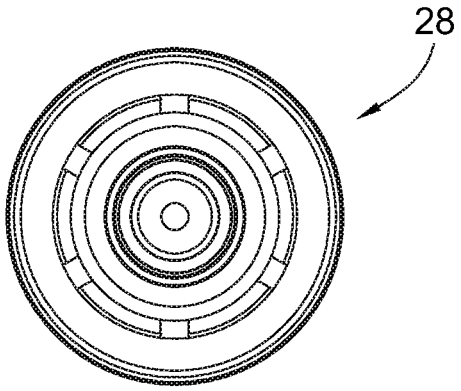
FIG. 32 is a top plan view of the FIG. 29 piston.
Figure 33:
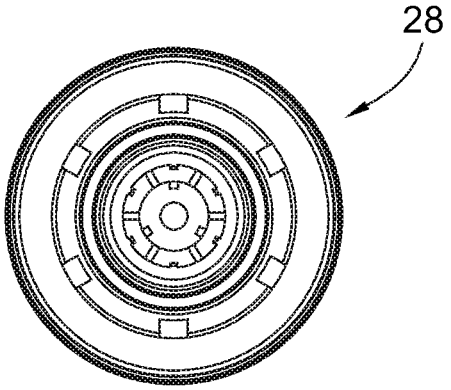
FIG. 33 is a bottom plan view of the FIG. 29 piston.
Figure 34:
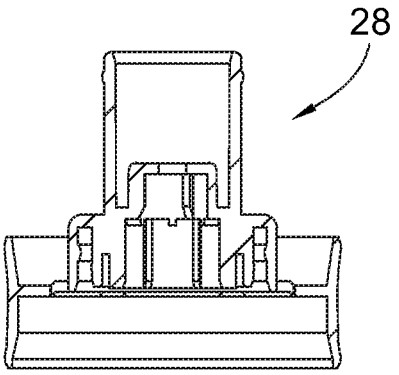
FIG. 34 is a front elevational view, in full section, of the FIG. 29 piston.
Figure 35:
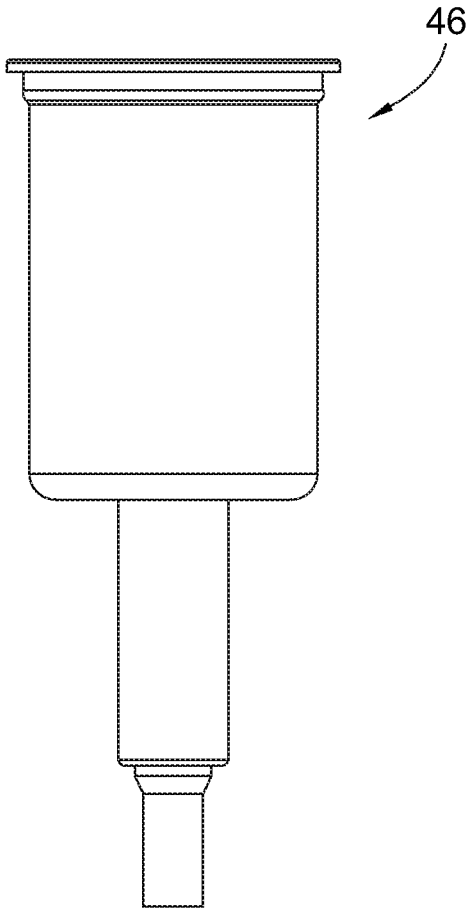
FIG. 35 is a front elevational view of the housing which comprises one component part of the FIG. 1 foamer.
Figure 36:
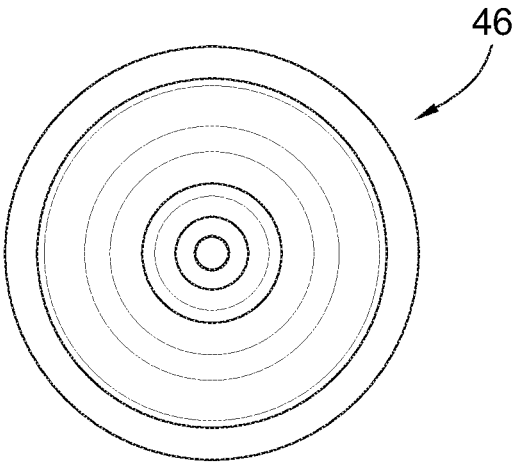
FIG. 36 is a top plan view of the FIG. 35 housing.
Figure 37:
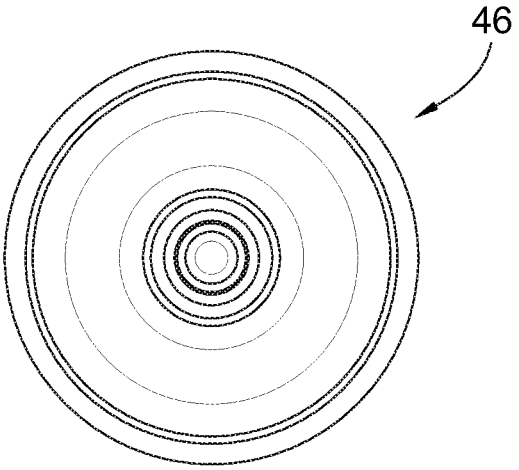
FIG. 37 is a bottom plan view of the FIG. 35 housing.
Figure 38:
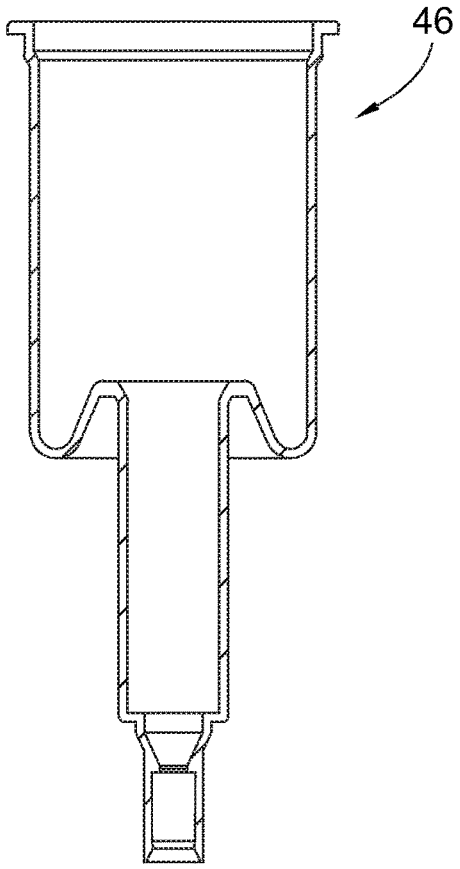
FIG. 38 is a front elevational view, in full section, of the FIG. 35 housing.

The overall external appearance of foamer 20 is shown in FIGS. 1-8. The assembly details of foamer 20 are shown in the full-section view of FIG. 9. Exploded views of the component parts of foamer 20 are shown in FIGS. 10-12. Focusing now on the assembly view and on the three exploded views of FIGS. 9-12, foamer 20 includes an actuator 22, sleeve 24, collar 26, air piston 28, air valve 30, liquid valve stem 32, liquid piston 34, spring 38, annular gasket seal 40, sleeve 42, ball 44 and housing 46.

Figure 3:
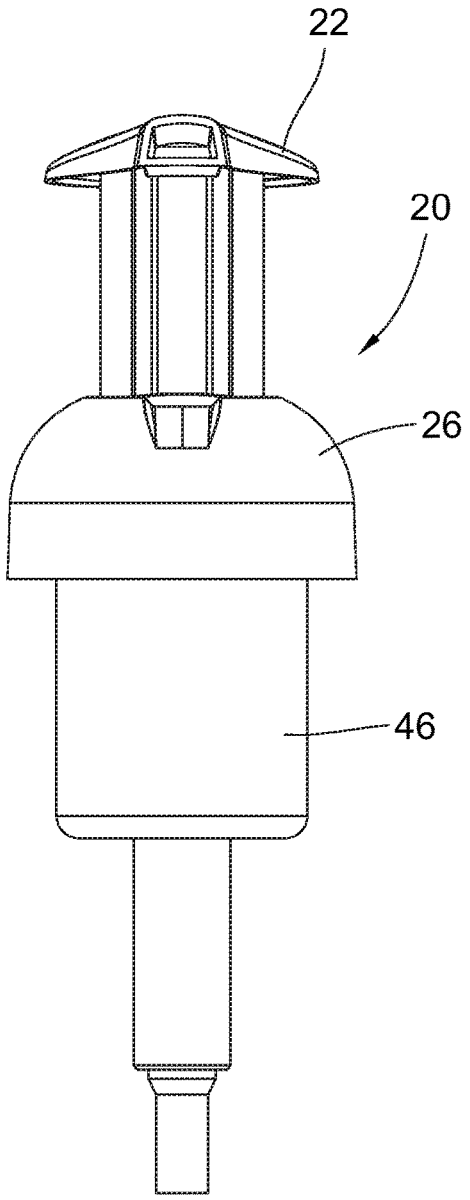
FIG. 3 is a front elevational view of the FIG. 1 foamer.
Figure 3A:
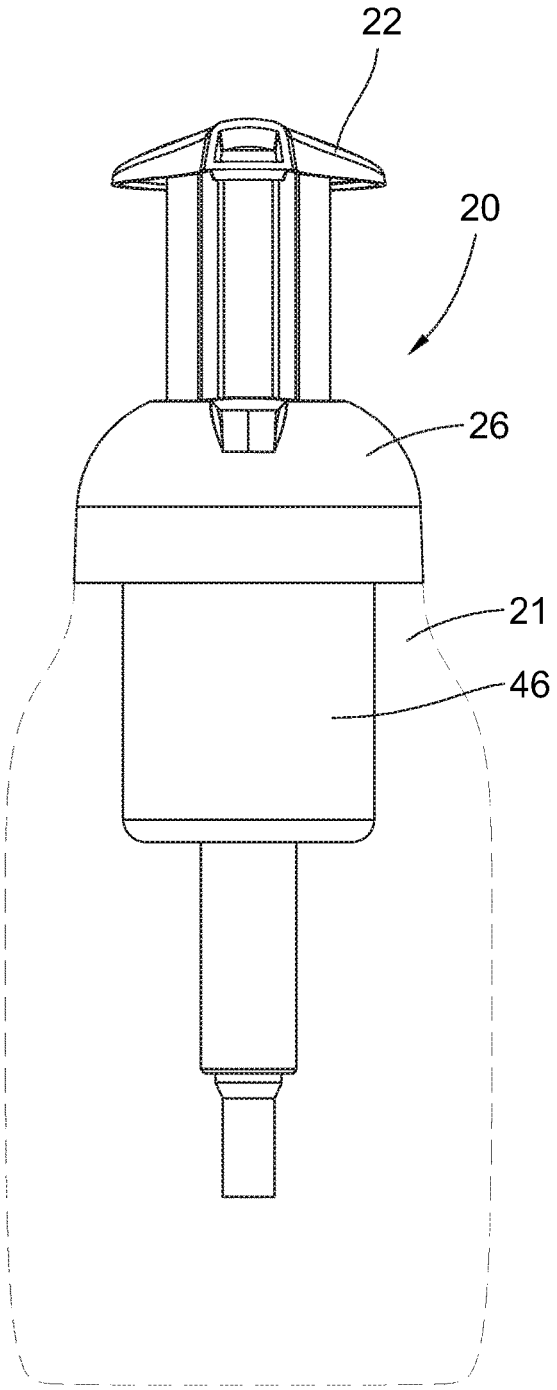
FIG. 3A is a front elevational view of the FIG. 1 foamer with a representative bottle shown in broken line form.
Figure 4:
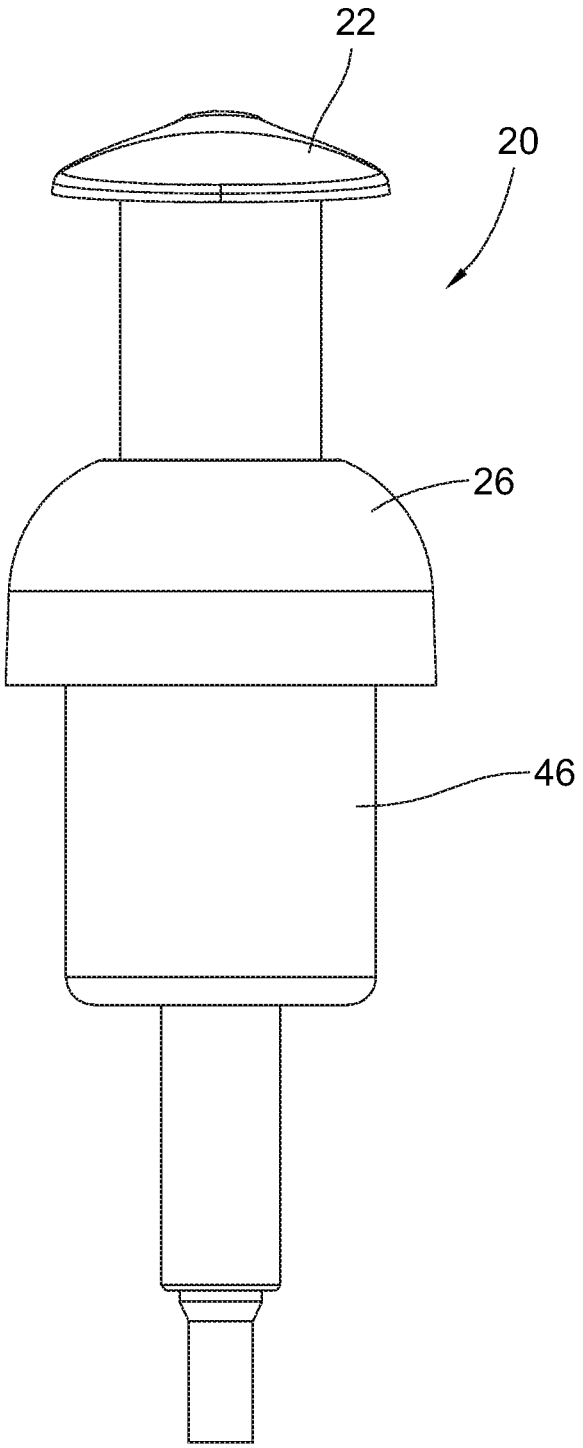
FIG. 4 is a rear elevational view of the FIG. 1 foamer.
Figure 5:
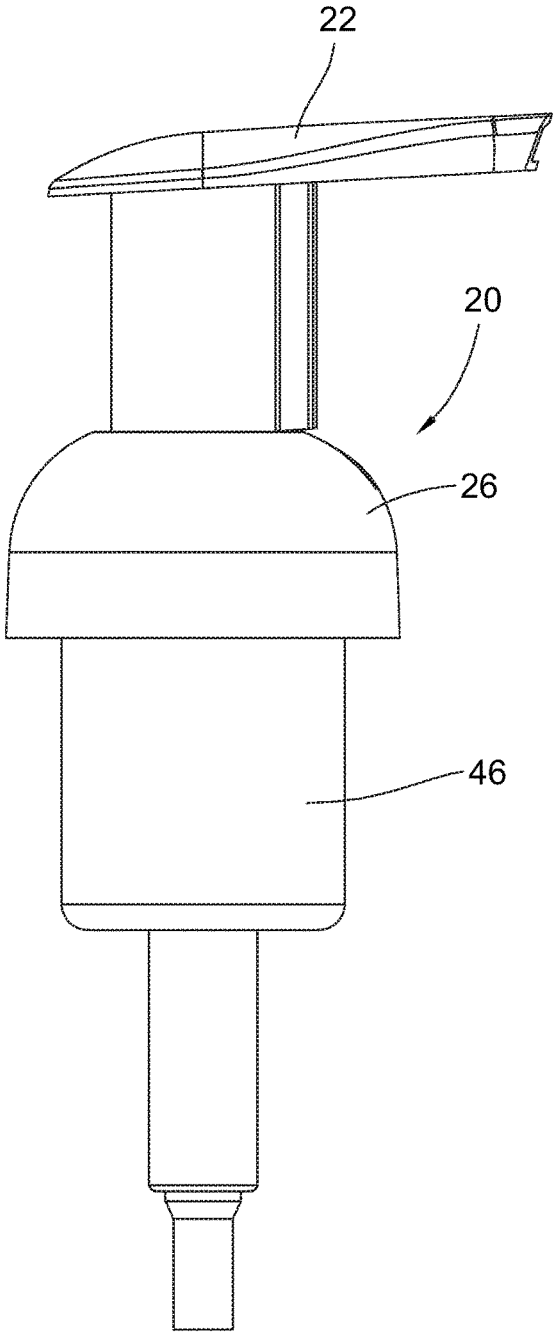
FIG. 5 is a left side elevational view of the FIG. 1 foamer.
Figure 6:
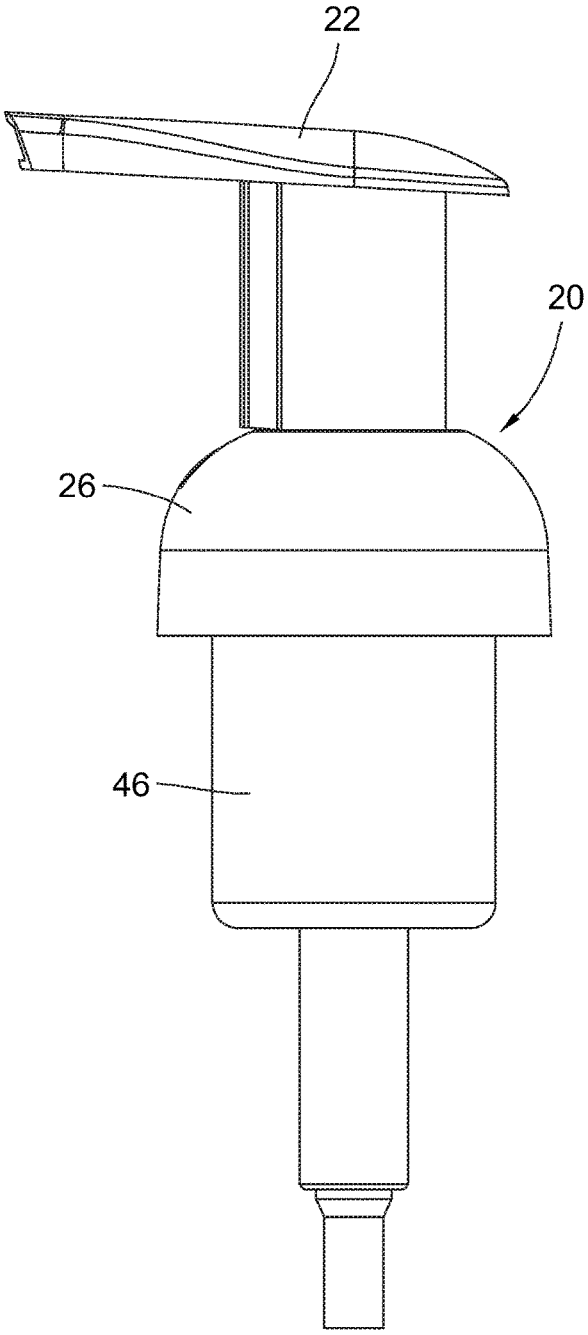
FIG. 6 is a right side elevational view of the FIG. 1 foamer.
Figure 7:
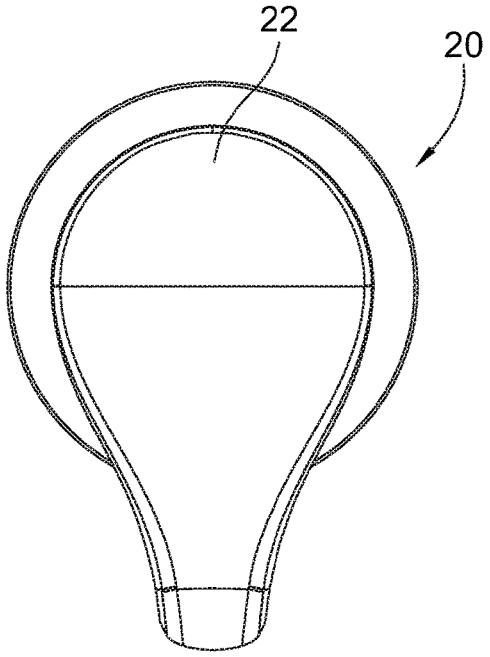
FIG. 7 is a top plan view of the FIG. 1 foamer.
Figure 8:
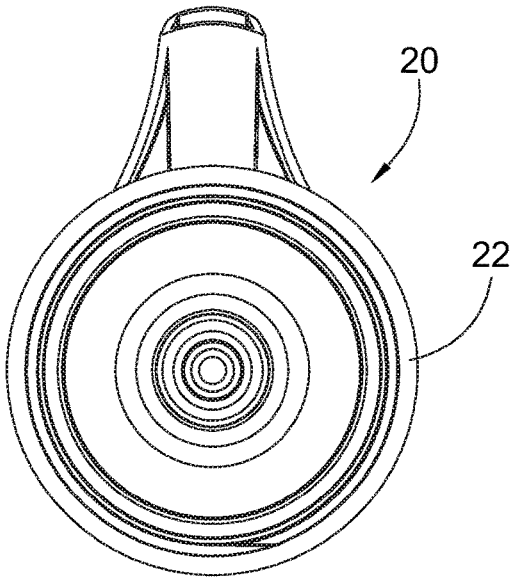
FIG. 8 is a bottom plan view of the FIG. 1 foamer.
Figure 9:
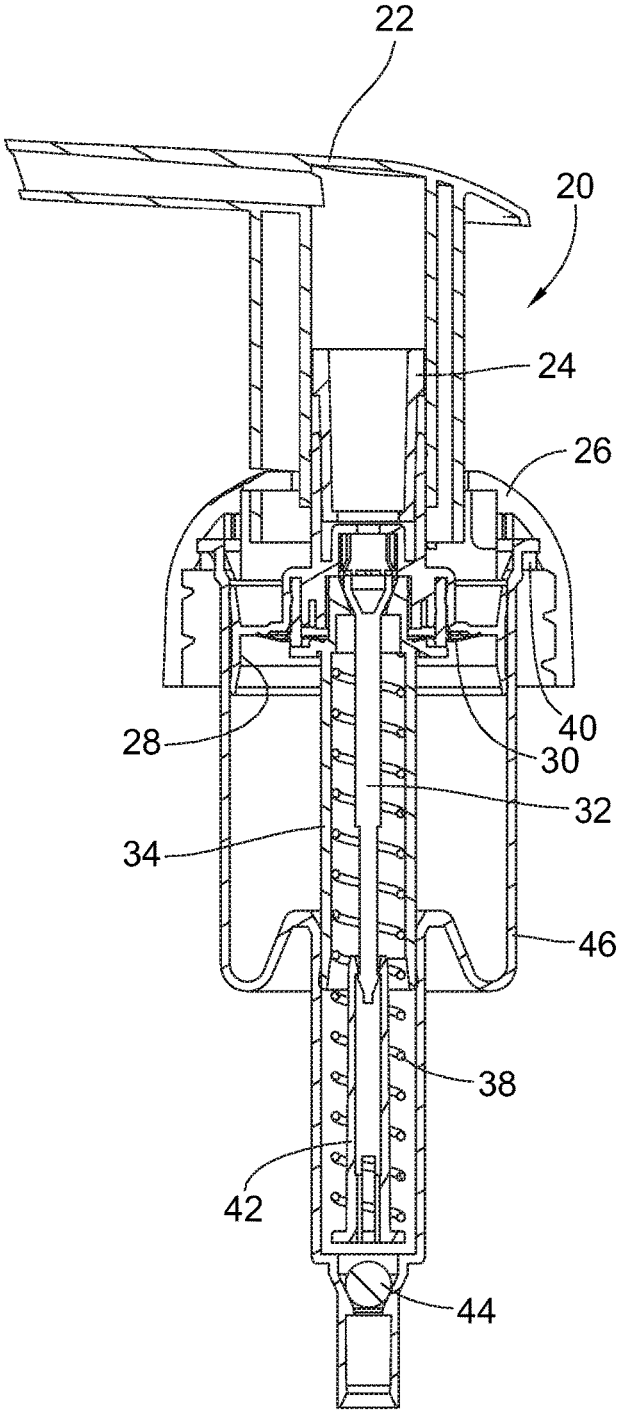
FIG. 9 is a right side elevational view, in full section, of the FIG. 1 foamer.

The overall appearance and structural details of actuator 22 are illustrated in FIGS. 13-21. The overall appearance and structural details of collar 26 are illustrated in FIGS. 22-28. The overall appearance and structural details of air piston 28 are illustrated in FIGS. 29-34. The overall appearance and structural details of housing 46 are illustrated in FIGS. 35-38. The remaining component parts are illustrated in FIGS. 9-12 as well as in FIGS. 39-41 and 46. In terms of operation and function of the identified component parts, these component parts cooperate and function in what would be understood as a normal or typical manner. While there are design changes provided by the exemplary embodiment of the present invention, when compared to typical prior art foamers, these design changes focus on sizing, dimensions and the ratio between selected dimensions, see FIGS. 39-46. Importantly, these sizes, dimensions and ratios of the exemplary embodiment have resulted in the creation of a novel and unobvious high output mini foamer 20 which has not previously existed. This high output mini foamer 20 provides a comparatively larger dose of dispensed product (as a foam) from a pump engine (i.e. foamer) which is assembled to a bottle (see FIG. 3A) with a comparatively smaller neck finish (less than 36 mm). It is this unique sizing along with several important dimensions and dimension ratios which create the novel and unobvious advance in the art of the present invention, as represented by the exemplary embodiment of FIGS. 1-46.

Figure 39:
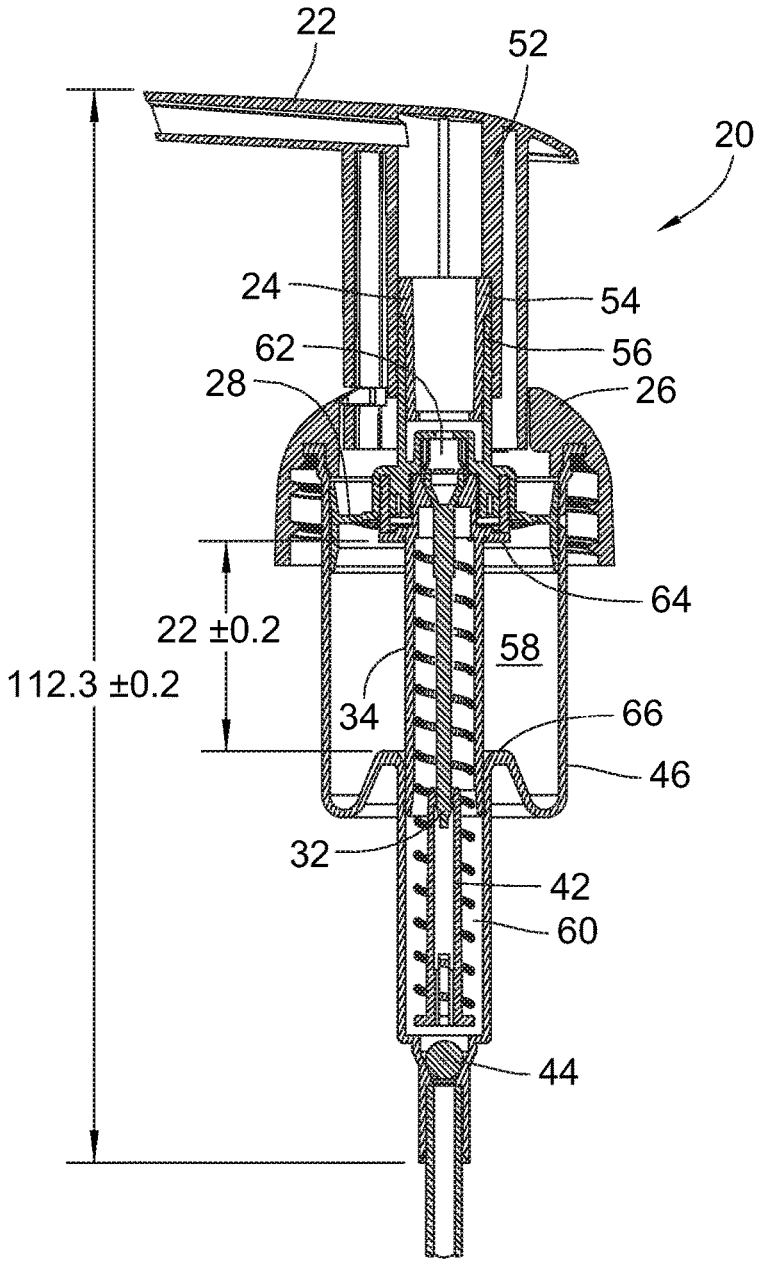
FIG. 39 is a right side elevational view of the FIG. 1 foamer in a first position corresponding to the start of the down stroke.
Figure 40:
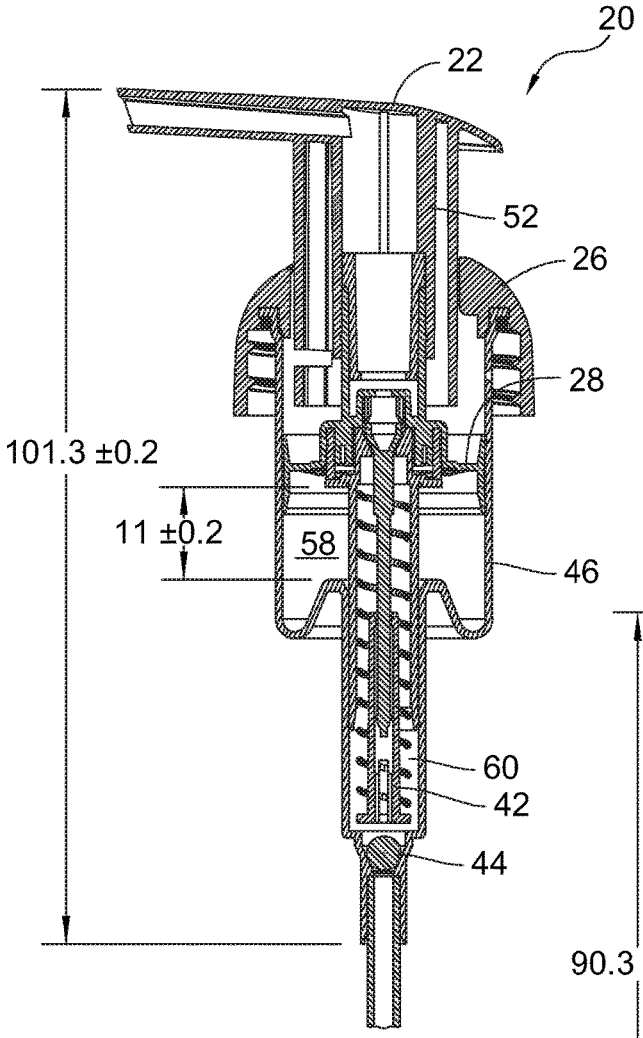
FIG. 40 is a right side elevational view of the FIG. 1 foamer in a second position corresponding to a midpoint of the down stroke travel.
Figure 41:
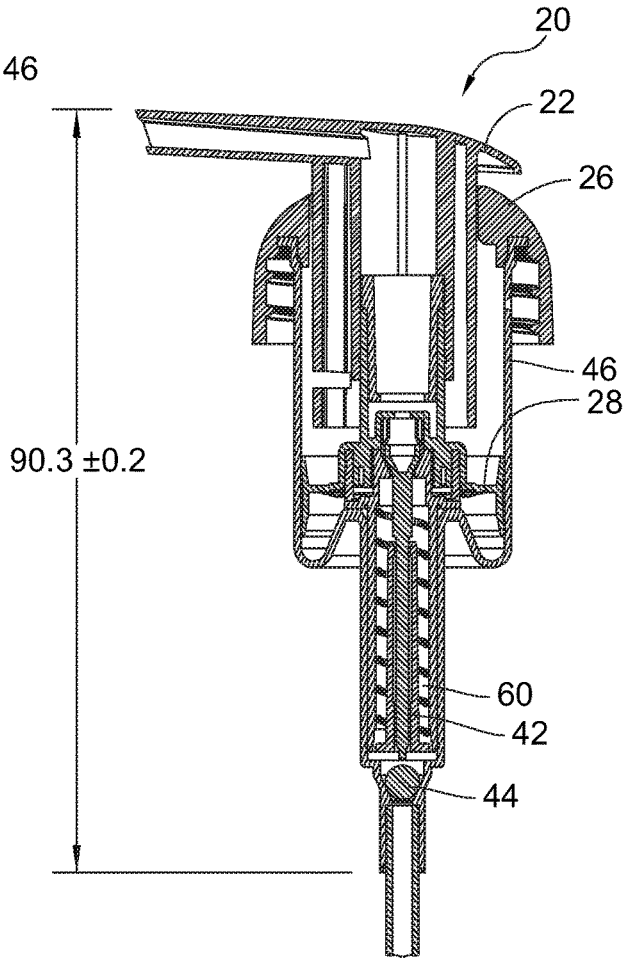
FIG. 41 is a right side elevational view of the FIG. 1 foamer in a third position corresponding to the end of the down stroke travel.

In terms of the use and operation of foamer 20, FIGS. 39-41 illustrate three different positions of foamer 20 related to a single dispensing stroke which involves the axial travel of actuator 22 in a downward direction towards the bottle.

The starting position of foamer 20 in FIG. 39 has the actuator 22 in a full-up position, at its highest axial point, with a moderate or modest level of spring-biasing force such that the actuator 22 is ready to begin downward axial travel as part of the designed dispensing stroke. As the actuator 22 is depressed in an axially downward direction toward the associated bottle (see FIG. 3A) its inner annular wall 52 which is offset, engages the upper portion 54 of sleeve 24 and thereby advances sleeve 24 in an axially downward direction. In turn, the upper portion 54 of sleeve 24 is in contact with an upper edge 56 of air piston 28 which causes downward axial travel of air piston 28 within housing 46. Housing 46 defines an air chamber 58 whose volume is reduced as the air piston 28 advances in an axially downward direction (i.e. toward the associated bottle). This reduction in volume results in an increase in internal pressure.

This described axial travel of air piston 28 also causes downward axial travel of liquid piston 34 within the lower chamber 60 of housing 46 as well as downward axial travel of liquid valve stem 32 within sleeve 42. The approximate midpoint or half-way point of the dispensing stroke (i.e. the downward axial travel of the actuator) is illustrated in FIG. 40.

As the described downward axial travel occurs, air is forced past air valve 30 into a mixing chamber location 62 or volume which is generally positioned within air piston 28 directly below (axially) sleeve 24. In a generally concurrent manner, liquid is forced upwardly into that same mixing chamber location 62. This pre-mix of air and liquid is then forced into sleeve 24 which is constructed and arranged to include one or more screens or mesh inserts (not illustrated) of a suitable style for aeration of the air and liquid mixture and for the generation of foam. The referenced screens or mesh inserts can be integral with the sleeve or can be separate components which either press in or snap into position. One design option for sleeve 24 is to include a coarse screen upstream from a fine screen which is downstream such that the quality of foam can be selectively managed depending on the product and consumer preferences by varying the nature of each screen as well as the number of screens.

The endpoint of the dispensing stroke and the end of the downward axial travel of actuator 22 is illustrated in FIG. 41. At this stage the dosage of foam has been dispensed and the user is ready to release the downward pressure on the top surface of the actuator 22. Releasing the downward pressure on the top surface of actuator 22 allows the spring 38 to return the foamer 20 to the FIG. 39 configuration for the next dispensing stroke. The axially upward travel of the air piston 28 creates a suction force which draws in makeup air into the air chamber and into the headspace of the bottle. At generally the same time, this negative pressure draws in the next charge of liquid from the bottle, flowing past ball 44.

With continued reference to FIGS. 39-46, the approximate stroke length is 22 mm. The referenced midpoint of travel illustrated in FIG. 40 is dimensioned at approximately 11 mm between the annular radial flange 64 of the liquid piston 34 and the abutment surface 66 of housing 46. The air portion and the liquid portion which are premixed and then aerated into foam have an air to liquid ratio by volume of approximately 7 to 1. The designed dosage is between approximately 1.0 cc and 1.1 cc. This dosage amount is a significant increase over the dosage amounts normally associated with current mini foamers which are known to have neck finish sizes less than 36 mm. The unique combination of structural features for foamer 20 results in a higher than expected dosage for a mini foamer where the associated neck finish is as small as 33 mm. In reaching this novel and unobvious combination of features, it was learned that there were several dimensions and dimension ratios which would be classified as either "important" or "notable". These notable dimensions are shown as letter designations in FIGS. 42-46 and the notable dimension ratios are stated herein.

Figure 42:
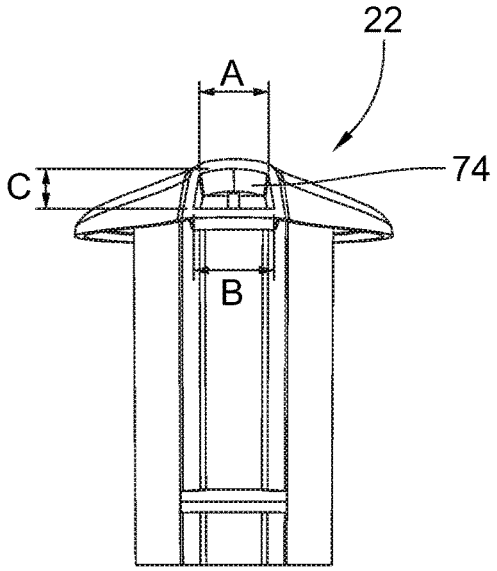
FIG. 42 is a front elevational view of the FIG. 13 actuator with some of the important dimensions shown.

With continued reference to FIGS. 42-46, dimension A of FIG. 42 is the top width of dispensing orifice 74 of actuator 22. Dimension B is the bottom width of orifice 74. Dimension C is the axial height of dispensing orifice 74. One notable ratio is B:C and another notable ratio is A:C. In the exemplary embodiment dimension A is approximately 6.10 mm, dimension B is approximately 7.08 mm and dimension C is approximately 3.53 mm.

Figure 43:
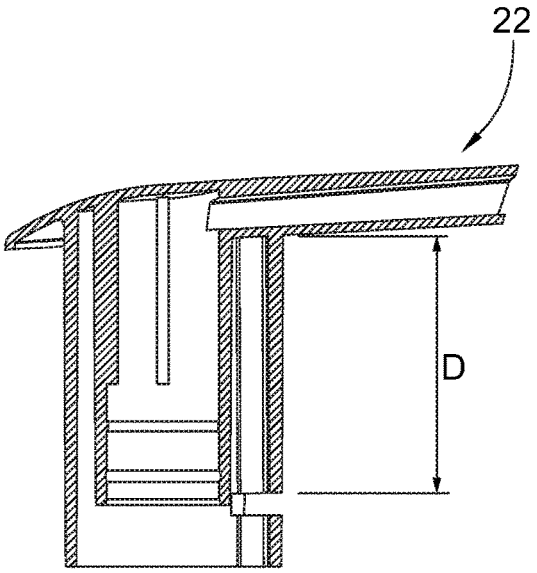
FIG. 43 is a left side elevational view of the FIG. 42 actuator, in full section, with an additional important dimension shown.
Figure 44:
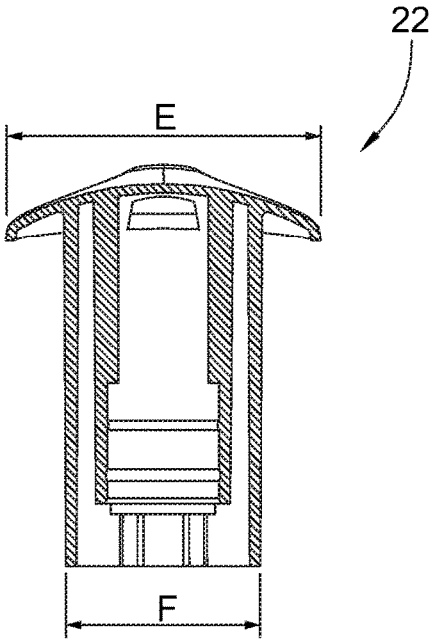
FIG. 44 is a front elevational view, in full section, of the FIG. 42 actuator with important dimensions shown.

FIGS. 43 and 44 include dimensions D, E and F. Dimension D is the assembled neck height of actuator 22. Dimension E is the top width of the actuator head. Dimension F is the neck diameter of the actuator. One notable ratio is D:C and another notable ratio is is D:F. A still further notable ratio is C:F. In the exemplary embodiment, dimension D is approximately 22.81 mm. Dimension E is approximately 27.89 mm. Dimension F is approximately 17.22 mm.

Figure 45:
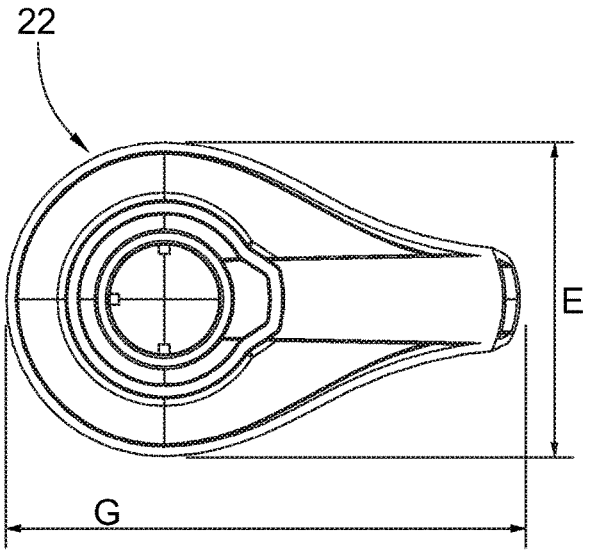
FIG. 45 is a top plan view of the FIG. 42 actuator with important dimensions shown.

In FIG. 45 the G dimension is the length of the actuator head. Dimension E is also shown in FIG. 45. One notable ratio is G:E. Dimension G is approximately 45.49 mm.

Figure 46:
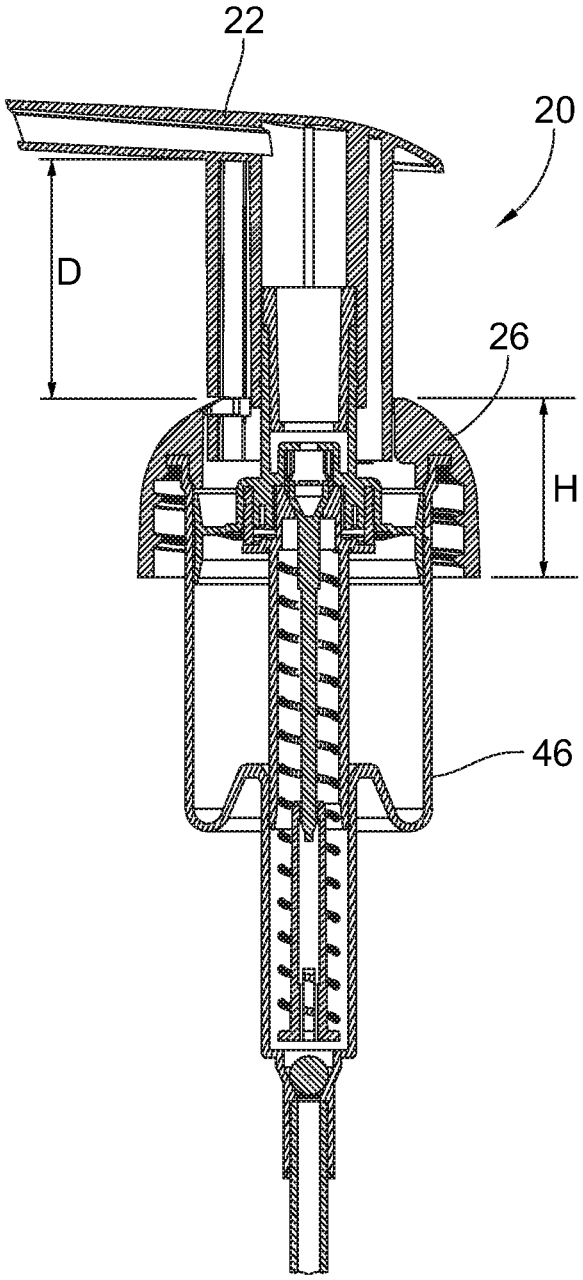
FIG. 46 is a right side elevational view of the FIG. 1 foamer with some of the important dimensions shown.

In FIG. 46 the H dimension is the height of the collar 26. Dimension D is also shown in FIG. 46. One notable ratio is D:H. Dimension H is approximately 18.64 mm.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A foamer for use in dispensing a dosage of a product, the dosage having a foam consistency, said foamer comprising:

a pump engine having an air piston contained within a housing defining an air chamber, a liquid piston contained within the air chamber that delivers liquid to a mixing chamber adjacent to the liquid piston, and an air valve that admits air from the air chamber into the mixing chamber wherein the pump engine is constructed and arranged to deliver a dosage for each complete stroke of between 0.9 and 1.1 cc wherein the dosage consists of a foam having an air to liquid ratio, by volume, of approximately 7:1;

a receptacle, which is constructed and arranged to retain an amount of liquid product for use in creating said dosage, having a neck finish with an outer diameter between 33 and 36 mm; and a closure element having an internally threaded collar, an actuator, a foaming element interposed between the mixing chamber and the dispensing orifice, and a sleeve coupled to an offset formed in an inner annular wall of the actuator;

wherein: (i) the actuator includes an outer neck wall spaced apart from and surrounding the inner annular wall, (ii) the actuator is coaxially received within a central aperture of the collar to accommodate approximately 22 mm of downward axial movement so that the sleeve and outer neck wall are received and disposed within the air chamber at a down-most position, (iii) a spring urges the air piston, the liquid piston, and the actuator axially upward and (iv) the pump engine is coupled to the closure element and the closure element is assembled to the neck finish.

2. The foamer of claim 1 wherein the downward axial movement of the actuator causes the sleeve to urge the air piston downward.

3. The foamer of claim 2 wherein the air piston urges the liquid piston downward.

4. The foamer of claim 3 wherein the housing further comprises a lower sleeve associated with the housing and wherein the lower sleeve receives a liquid valve stem attached to the liquid piston.

5. The foamer of claim 1 wherein the liquid piston includes an annular radial flange and wherein an abutment surface formed in the housing at a lower end of the air chamber prevents further downward axial movement.

* * * * *